US007720397B2

(12) United States Patent
Filbrich et al.

(10) Patent No.: US 7,720,397 B2
(45) Date of Patent: May 18, 2010

(54) SYSTEMS AND METHODS FOR MONITORING TONER USAGE

(75) Inventors: Walter Filbrich, Manhattan Beach, CA (US); Brent Richtsmeier, Laguna Niguel, CA (US)

(73) Assignee: Samsung Electronics Co., Ltd., Suwon, Gyeonggi-do (KR)

( * ) Notice: Subject to any disclaimer, the term of this patent is extended or adjusted under 35 U.S.C. 154(b) by 319 days.

(21) Appl. No.: 11/242,503

(22) Filed: Oct. 3, 2005

(65) Prior Publication Data

US 2007/0077075 A1 Apr. 5, 2007

(51) Int. Cl.
*G03G 15/08* (2006.01)

(52) U.S. Cl. ..... 399/27

(58) Field of Classification Search ..... 399/27–30, 399/49, 61

See application file for complete search history.

(56) References Cited

U.S. PATENT DOCUMENTS 5,349,377 A * 9/1994 Gilliland et al. ..... 347/131
5,655,174 A * 8/1997 Hirst ..... 399/27
5,937,225 A * 8/1999 Samuels ..... 399/27
6,810,218 B1 10/2004 Wong et al.
6,895,193 B2 * 5/2005 Takamatsu et al. ..... 399/27
2005/0169648 A1 * 8/2005 Kin et al. ..... 399/27

* cited by examiner

*Primary Examiner*—David M Gray
*Assistant Examiner*—Andrew V Do
(74) *Attorney, Agent, or Firm*—Knobbe, Martens, Olson & Bear, LLP

(57) ABSTRACT

Systems and methods for estimating the amount of imaging material, such as toner, used in a printing device. In one example, a system estimates toner usage from imaging data and accounts for a "diffusion effect" caused by non-adjacent pixel groups. In certain embodiments, the system examines sets of pixel locations within a page. For example, the system may evaluate each set of eight adjacent pixel locations (i.e., a byte of information) on a page. For each pixel location set, the system determines a proximity factor that is indicative of the number of independent pixel groups within the respective pixel location set. The system then calculates a proximity value based on at least a portion of the proximity factors and uses the proximity value and a pixel count for the page to estimate a toner usage amount.

20 Claims, 4 Drawing Sheets

SYSTEMS AND METHODS FOR MONITORING TONER USAGE

BACKGROUND OF THE INVENTION

1. Field of the Invention

This invention relates to printers and, in particular, to systems and methods for monitoring toner consumption in printing devices.

2. Description of the Related Technology

Even with the increasing use of the Internet, email and digital media, the volume of printed matter produced by businesses continues to rise. Millions of tons of imaging material, such as toner, is consumed in the United States each year. Furthermore, printing purchases make up a significant percentage of corporate expenditures, and downtime due to broken printing devices or waiting for replacements of empty toner cartridges can add to these expenses.

In view of the foregoing, several systems and methods have been developed for measuring toner consumption. Conventional methods for measuring toner consumption may be classified into two general categories. The first category of toner measurement methods utilizes a mechanical switch that monitors the physical level of the toner in the cartridge. When the toner drops below a predetermined level, the switch closes, resulting in a "low toner" signal being transmitted to a user interface of the printer or to a remote location via network protocols. A major drawback of this first category is that there is no measurement of toner consumption available to the user until the toner actually reaches a low level. For example, the user is not informed of progressive levels of consumption, such as when there is 75% or 50% of the toner remaining.

The second category of toner measurement methods utilizes a page pixel count from the image data sent to the printer. In general, the number of pixels on a particular page is an indication of the amount of toner used for that page. Such mapping of page pixel count to toner usage also allows for continuous monitoring of toner consumption and for providing a "gas gauge" of the toner to the user.

The relationship between pixel count and toner consumption, however, is not linear. Rather, due to a "diffusion effect," images having the same number of pixels, but having different positioning of pixels, consume different amounts of toner. For example, the amount of toner used to print a number of pixels that are positioned next to each other is generally less than the amount of toner used to print the same number of pixels dispersed throughout a page. To address this diffusion effect, at least one system includes logic for counting the number of pixel transitions (i.e., laser on to laser off, laser off to laser on) per scan line for a particular image. The system then uses a ratio of the transition count to the pixel count to estimate the toner consumption for the particular image.

SUMMARY OF CERTAIN INVENTIVE ASPECTS OF THE INVENTION

In view of the foregoing, a need exists for systems and methods that provide an improved estimation of toner consumption. A need also exists for a more straightforward method for calculating the effect of pixel positioning on toner consumption.

In an embodiment, a method is disclosed for monitoring toner usage in an electronic printing device. The method includes determining a pixel count for a page and calculating a plurality of proximity factors, wherein each of the plurality of proximity factors is indicative of a number of pixel groups within each of a plurality of sets of pixel locations within the page. The method further includes calculating a proximity value based on the plurality of proximity factors and providing an estimate of toner usage for the page based at least on the pixel count and the proximity value.

In an embodiment, a system is disclosed for estimating the usage of imaging material based on image data. The system includes a controller, a cartridge and an electronic module. The controller is configured to output image data indicative of an image to be printed on a page. The cartridge comprises imaging material and is configured to selectively transfer the imaging material to print the image on the page based on the image data. The electronic module is in communication with the controller to receive the image data and is configured to calculate an estimated imaging material usage amount for the page based on a pixel count and a proximity value indicative of a number of pixel groups within each of a plurality of sets of pixel locations on the page.

In an embodiment, a machine loadable software program for a processor is disclosed for estimating toner usage of a printing device. The software program includes first computer instructions for determining a pixel count for a page and second computer instructions for determining a proximity factor for each of a plurality of sets of pixel locations on the page, each proximity factor being indicative of a number of pixel groups within a respective pixel location set. The software program further includes third computer instructions for calculating a proximity value based on the plurality of proximity factors and fourth computer instructions for providing an estimate of toner usage for the page based at least on the pixel count and the proximity value.

In an embodiment, a printing system is disclosed for estimating toner usage. The printing system includes means for determining a pixel count for a page and means for determining a proximity factor for each of a plurality of sets of pixel locations within the page, each proximity factor being indicative of a number of pixel groups within a respective pixel location set. The printing system further includes means for calculating a proximity value for the page based on the plurality of proximity factors and means for providing an estimate of toner usage for the page based at least on the pixel count and the proximity value.

In another embodiment of the invention, a method is disclosed for monitoring toner usage in an electronic printing device, wherein the method includes providing an estimate of toner usage for a page based at least on a pixel count of at least one image on the page and a proximity of adjacent pixels in the at least one image.

For purposes of summarizing the invention, certain aspects, advantages and novel features of the invention have been described herein. It is to be understood that not necessarily all such advantages may be achieved in accordance with any particular embodiment of the invention. Thus, the invention may be embodied or carried out in a manner that achieves or optimizes one advantage or group of advantages as taught herein without necessarily achieving other advantages as may be taught or suggested herein.

DETAILED DESCRIPTION OF CERTAIN EMBODIMENTS OF THE INVENTION

In a typical electrophotographic printing process, a photoconductive member is charged to a substantially uniform potential so as to sensitize the surface thereof. The charged photoconductive member is selectively exposed to dissipate charges in the irradiated areas and to record an electrostatic latent image. After the electrostatic latent image is recorded on the photoconductive member, the latent image is developed by bringing an imaging material, such as toner, into contact with the photoconductive member. The toner particles are attracted to the latent image to form a toner powder image on the photoconductive member. The toner powder image is then transferred from the photoconductive member to a copy sheet. Generally, the toner particles are heated to permanently affix the powder image to the copy sheet.

In certain printers and copiers, an electronic module generally has available the actual number and distribution of pixels in every image. In certain embodiments of the invention, the electronic module counts the number of pixels in a printed image and calculates a proximity value based on the relative positioning of the pixels in sets of pixel locations. The electronic module then uses the page pixel count and the proximity value to estimate the amount of toner used in developing the printed image. The estimated amount of toner consumed may be further used for controlling the addition of toner to the developer housing in a dual component development system or to indicate the remaining toner left in a printer cartridge of a single component development system. For example, in a single component development system, a warning signal may be given to the user when the toner reaches a "low" level.

Certain inventive features of the systems and methods will now be described with reference to the drawings summarized above. The drawings, associated descriptions, and specific implementation are provided to illustrate embodiments of the invention and not to limit the scope of the disclosure.

Figure 1:
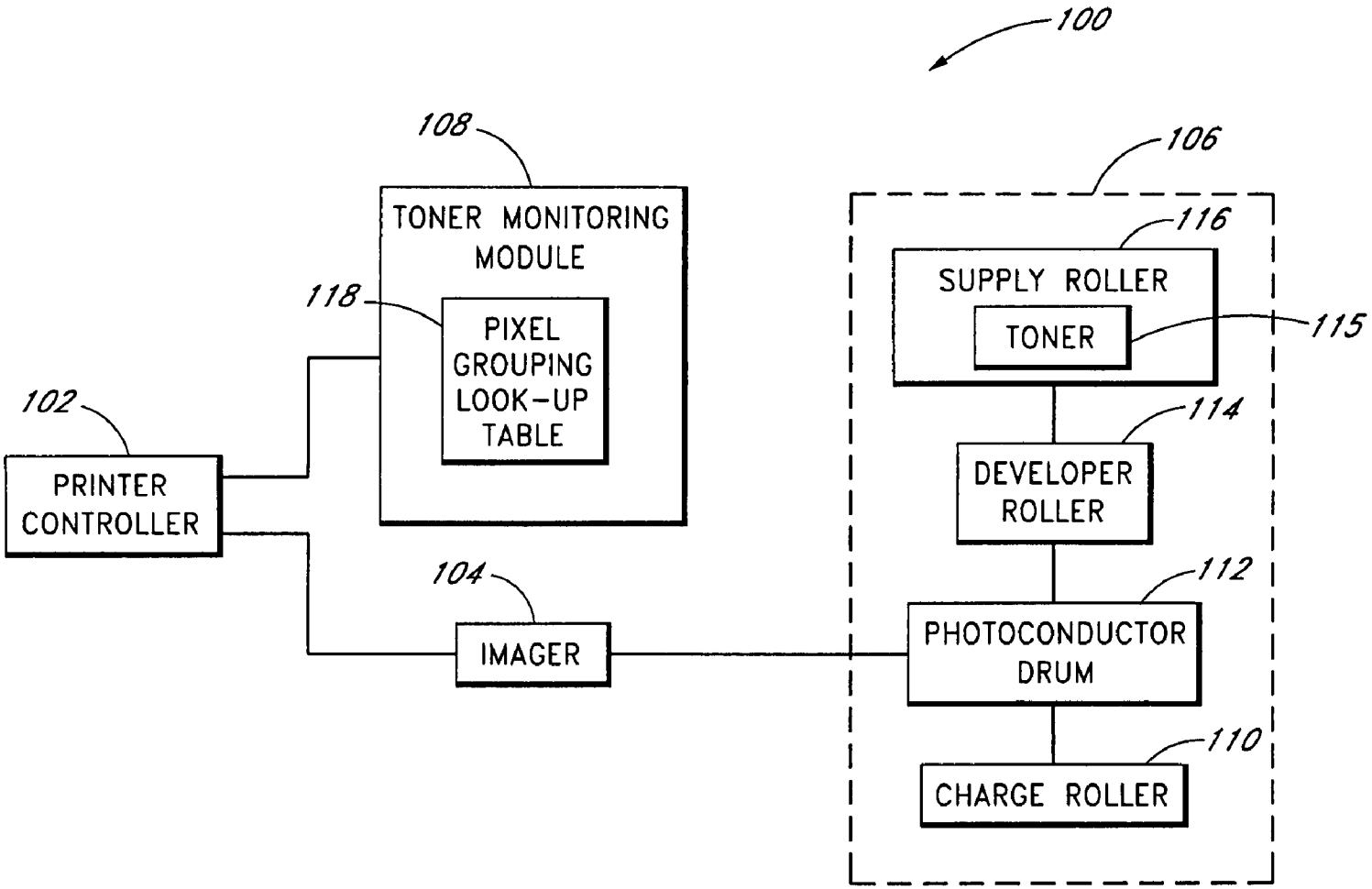
FIG. 1 illustrates a block diagram of an electronic printing device having a toner usage monitoring module, according to certain embodiments of the invention.

FIG. 1 is a block diagram of an electronic printing device 100, according to certain embodiments of the invention. In certain embodiments, the electronic printing device 100 is a printer, a fax machine, a copier, or a multi-function peripheral (MFP) device, which includes a single device configured to perform multiple functions, for example, copying, printing, faxing, combinations of the same and the like. For instance, the electronic printing device 100 may be capable of performing an electrophotographic printing process as described above. The electronic printing device may also be capable of printing in color, grayscale, and/or black and white.

The illustrated electronic printing device 100 includes a printer controller 102, an imager 104 and a printer cartridge 106. In certain embodiments, the controller 102 drives the imager 104 to create an image that is transferred by the printer cartridge 106 to a copy sheet, for example, a sheet of paper.

In certain embodiments, the printer cartridge 106 comprises a toner cartridge. As shown, the printer cartridge 106 includes a charge roller 110, a photoconductor drum 112, a developer roller 114 and toner 115 within a supply roller 116. For example, the photoconductor drum 112 may comprise an organic drum.

In certain embodiments, during a printing operation, the photoconductor drum 112 is initially charged by the charge roller 110. The surface of the photoconductor drum 112 is then imaged by the imager 104, which is driven by the printer controller 102. The latent image formed on the surface of the drum 112 may then be developed by a developer roller 114 fed imaging material, such as the toner 115, by the supply roller 116.

With continued reference to FIG. 1, the printing device 100 further includes a toner usage monitoring module 108 that communicates with the printer controller 102. In certain embodiments, the module 108 is capable of estimating toner consumption based at least on information received from the controller 102 and/or the cartridge 106. For example, the module 108 may receive from the printer controller 102 data associated with an image to be printed. In certain embodiments, such data is supplied by the printer controller 102 in an electronic pixel (or bit) stream format.

Such data may also be used by the module 108 to calculate the number of pixels used in a particular image and/or the relative locations or groupings of pixels within the image. The module 108 may then process these calculations to estimate an amount of toner consumption for a particular image or page. Furthermore, the module 108 may advantageously store data regarding toner consumption in a memory, for example, an electrical erasable programmable read only memory (EEPROM).

The illustrated toner usage monitoring module 108 further includes a pixel grouping look-up table 118 usable to calculate a proximity factor for pixel grouping(s) within a particular set of pixel locations. In certain embodiments, the proximity factor is indicative of the relative positioning of one or more pixels. For example, the calculated proximity factor may correspond to the number of pixel groupings in a set of eight adjacent pixel locations (a byte) in a scan line. Such proximity factors may then be used by the module 108 to estimate the amount of toner used to print a particular image or a page.

The phrase "pixel grouping" as used herein is a broad phrase and is used in its ordinary sense and includes, without limitation, one or more adjacent pixels within an image. For example, a pixel grouping may comprise adjacent pixels in a predetermined set of pixel locations within a scan line. The phrase "pixel location" as used herein is a broad phrase and is used in its ordinary sense and includes, without limitation, an area within an image encompassed by a single pixel. A "pixel location set" comprises a predetermined number of adjacent pixel locations.

In certain embodiments, the module 108 may comprise logic embodied in hardware or firmware and/or comprise a collection of software instructions written in a programming language, such as, for example C++. A software module may be compiled and linked into an executable program, installed in a dynamic link library, or may be written in an interpretive language such as BASIC. It will be appreciated that software modules may be callable from other modules or from themselves, and/or may be invoked in response to detected events or interrupts. Software instructions may be embedded in firmware, such as an EPROM or EEPROM. It will be further appreciated that hardware modules may be comprised of connected logic units, such as gates and flip-flops, and/or may be comprised of programmable units, such as programmable gate arrays or processors.

It is also contemplated that, in certain embodiments, components of the toner usage monitoring module 108 may be integrated in different forms. For example, the module 108 may be separated into several subcomponents or may be separated into more devices or sets of software code that reside at different locations and that communicate with each other, such as through a wired or wireless communication. For instance, portions or all of the module 108 may be incorporated within the printer controller 102, the imager 104 and/or the printer cartridge 106. In yet other embodiments, the software portions of the module 108 may be executed on one or more processors.

Figure 2:
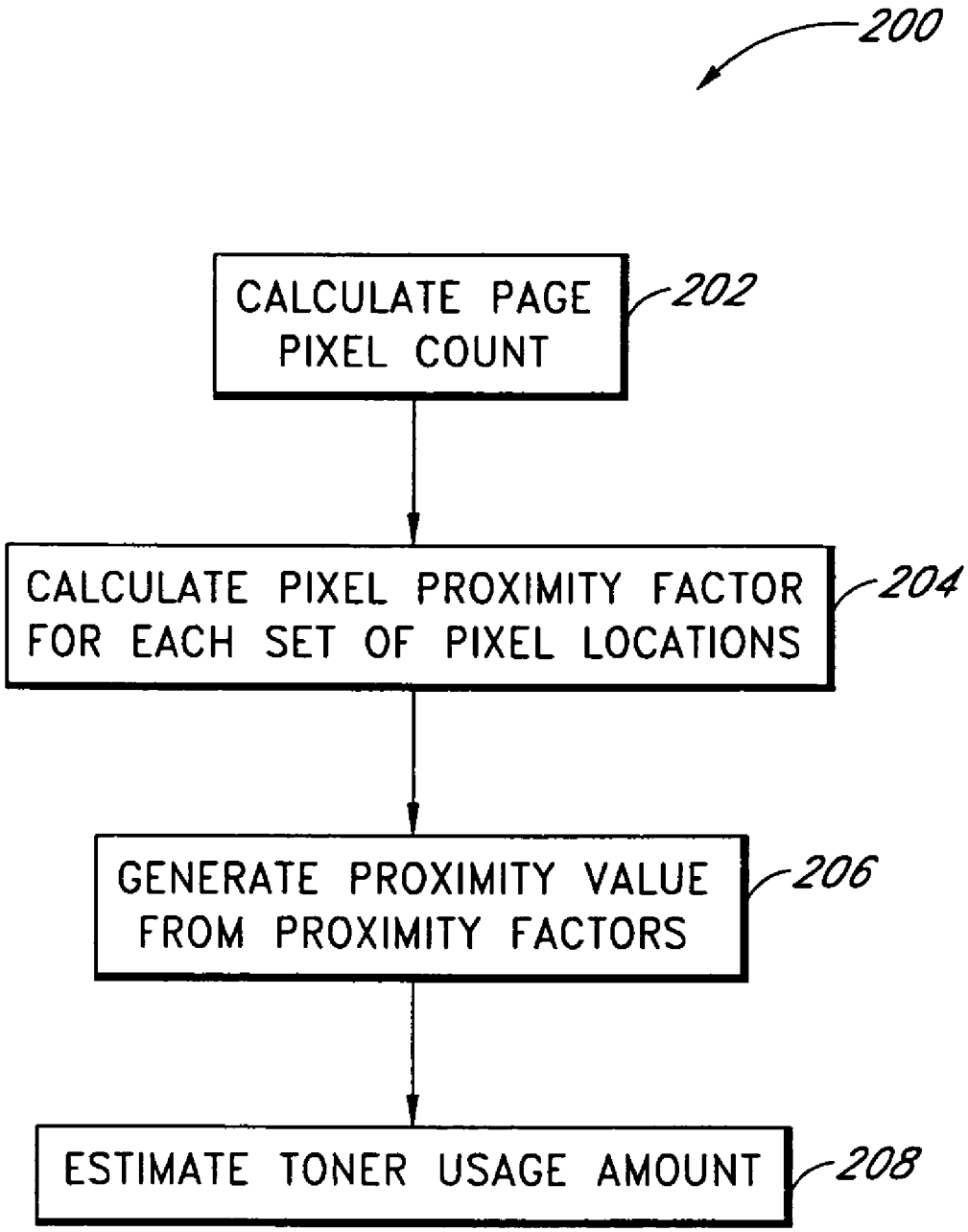
FIG. 2 illustrates an exemplary flowchart of a toner usage estimation process usable by the toner usage monitoring module of FIG. 1.

FIG. 2 illustrates a flowchart of a toner usage estimation process 200, according to certain embodiments of the invention. For example, the estimation process 200 may be performed by the electronic printing device 100 to estimate the amount of toner used in printing a particular image or page. Furthermore, the toner usage estimation process 200 may be used to inform a user how much toner is remaining in the cartridge 106 and/or when the cartridge 106 has a "low" toner level and needs to be replaced. For exemplary purposes, the estimation process 200 will be described herein with reference to the components of the electronic printing device 100 illustrated in FIG. 1.

Beginning with block 202, the toner usage monitoring module 108 calculates the number of pixels used to print an image on a particular page. In certain embodiments, the module 108 may comprise a field programmable gate array (FPGA) that receives electronic data (e.g., an electronic pixel stream) from the printer controller 102 that represents the image to be printed. For example, the FPGA may comprise a pixel counter configured to keep a record of the pixels on the page. In other embodiments, the module 108 may comprise other logic or software usable to count pixels in a particular image. In yet other embodiments, the pixel count information is transmitted to the module 108 along with the image data.

At block 204, the toner usage monitoring module 108 calculates a pixel proximity factor for each set of pixel locations within the image. In certain embodiments, the pixel proximity factor is based on the number of pixel groupings within a set of adjacent pixel locations. For example, a pixel location set having three independent pixel groupings may be assigned a proximity factor that is different than a proximity factor assigned to a pixel location set having one independent pixel grouping. In certain embodiments, a higher proximity factor is advantageously assigned to pixel location sets having a higher number of pixel groupings. In such embodiments, the higher proximity factor is indicative of a greater "diffusion effect" due to the relative positioning of the pixels.

Once the pixel proximity factors have been calculated for the pixel location sets within a particular image or page, the estimation process 200 proceeds with block 206. At block 206, the toner usage monitoring module 108 generates a proximity value based on one or more of the proximity factors. In certain embodiments, the proximity value represents the effect of the placement of pixels on the estimated toner consumption for a particular page and/or image.

At block 208, the toner usage monitoring module 108 estimates a toner usage amount based at least on the pixel count and the calculated proximity value. For example, the module 108 may access a table that includes toner usage amounts that are related to a range of pixels counts and proximity values. In other embodiments, the module 108 may execute one or more algorithms to calculate an estimated toner usage based on the pixel count and the proximity value. In such embodiments, the one or more algorithms may be derived from data obtained from printing a plurality of test sheets with a predetermined number of pixels and/or different combinations of pixel groupings. The estimated toner usage amount may be, in turn, subtracted from a previous toner remaining amount to indicate a new percent or level of toner remaining.

For example, in certain embodiments, as each page is printed, the pixel count and proximity value are monitored for the page in an FPGA of the module 108. These counts and values are processed by the module 108 to estimate the toner used for each page. The resulting estimated toner amount is subtracted from the previous remaining balance of toner. This new toner remaining percentage value is saved and transmitted to and stored in a memory of the module 108. This process continues until a warning level for remaining toner is attained (e.g., a "low" toner signal). The user is then alerted that the toner is nearing its "end-of-life" condition and/or that a replacement toner cartridge should be obtained. The process then continues until a calculated remaining toner percentage of zero is attained, which should advantageously coincide with the toner cartridge being empty. That is, continuously subtracting estimated toner usage from a known toner amount (e.g., when initially installed), or a previously calculated remaining amount, allows for toner usage monitoring by using printer imaging, without the need to sense or examine the toner container itself.

The methods and systems disclosed herein can also provide substantial hardware cost savings, and repair or maintenance cost savings, as compared to other sensor systems that require optical, sonic, torque, weight or other sensors in or associated with the toner supply or dispenser, and associated wiring.

The blocks described with respect to the estimation process 200 illustrated in FIG. 2 are not limited to any particular sequence. Rather, the blocks relating thereto can be performed in other sequences that are appropriate. For example, described blocks may be performed in an order other than that specifically disclosed or may be executed in parallel, or multiple blocks may be combined in a single block. For example, the pixel page count (block 202) may be calculated concurrently with and/or after the calculation of the pixel proximity factors (block 204) or the proximity value (block 206).

Furthermore, not all blocks of the estimation process 200 need to be executed or additional blocks may be included without departing from the scope of the disclosure. For instance, in certain embodiments of the invention wherein the estimated toner usage is based on at least one proximity factor instead of a proximity value, the estimation process 200 may omit block 206.

Figure 3:
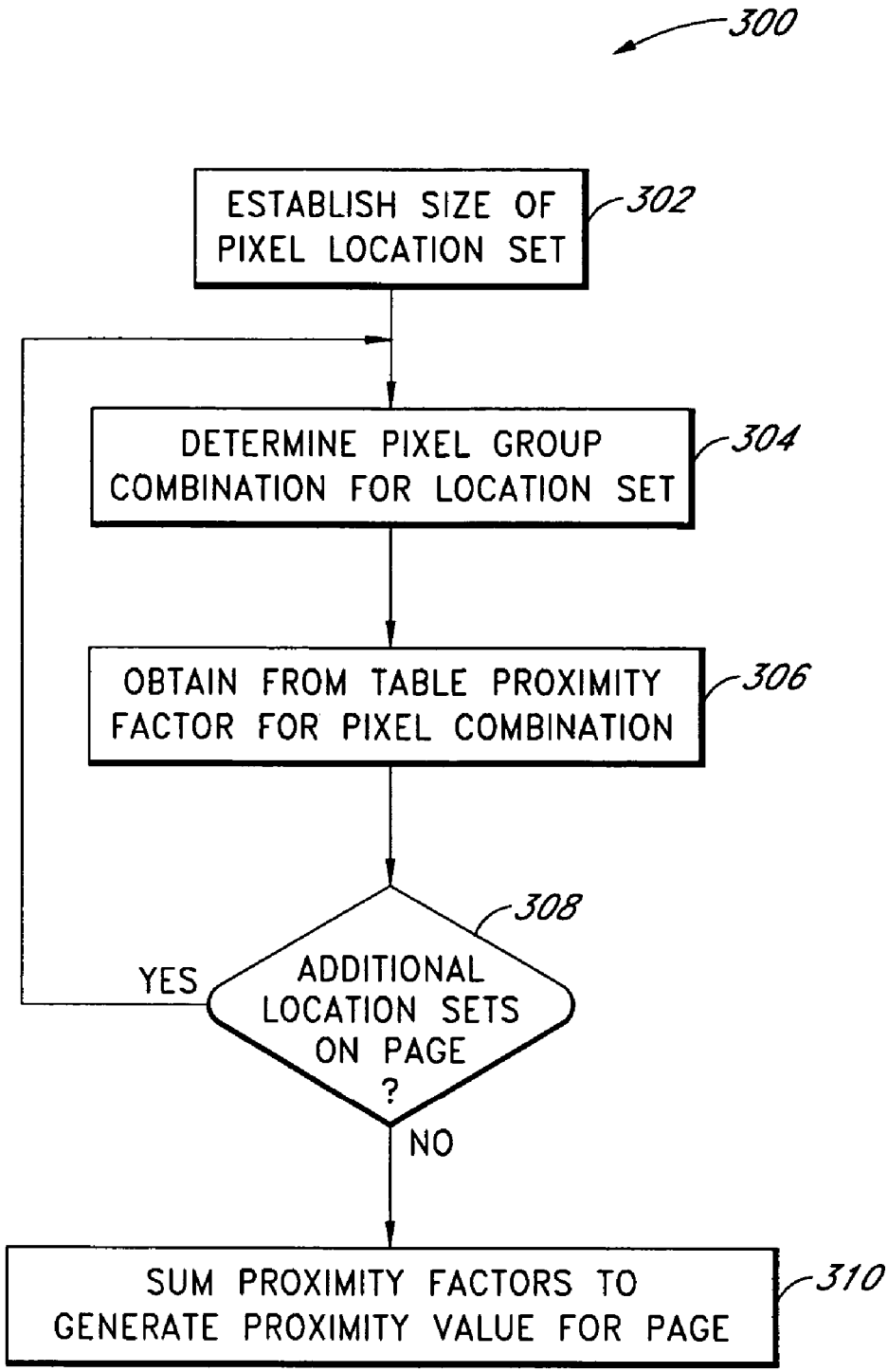
FIG. 3 illustrates an exemplary flowchart of a proximity value calculation process usable by the toner usage monitoring module of FIG. 1.

FIG. 3 illustrates a flowchart of a proximity value calculation process 300, according to certain embodiments of the invention. For example, the calculation process 300 may be performed by the electronic printing device 100 to determine the effect of the relative locations of the pixels on the estimated toner usage for printing a particular image or page. In certain embodiments, the calculation process 300 is performed during blocks 204 and 206 of the toner usage estimation process 200 illustrated in FIG. 2. For exemplary purposes, the calculation process 300 will be described herein with reference to the components of the electronic printing device 100 illustrated in FIG. 1.

The calculation process 300 begins with block 302, wherein the toner usage monitoring module 108 establishes a size for the sets of pixel locations to be evaluated. In certain embodiments, the module 108 determines that each location set has eight adjacent pixel locations (i.e., a byte of information). In other embodiments, other lengths or amounts of pixel locations may be used. Furthermore, in certain embodiments, the size of the pixel location sets evaluated by the module 108 may be fixed or independently selectable for all iterations of the calculation process 300. For instance, in certain embodiments, the module 108 may be configured to evaluate only sets of eight adjacent pixel locations. In other embodiments, the size of the pixel location set may change with each execution of the process 300.

After the size of the pixel location set has been established, the calculation process 300 proceeds with block 304. At block 304, the module 108 determines the pixel combination for each pixel location set in the image and/or page. For example, 256 (i.e., $2^8$) unique pixel combinations exist for a pixel location set having eight adjacent pixel locations in a scan line. In such an embodiment, the various combinations include 00000001, 00000010, 00000011, . . . 11111111, wherein a "1" represents a pixel location having a pixel (i.e., "on"), and a "0" represents a pixel location not having a pixel (i.e., "off").

At block 306, the module 108 uses the determined pixel combination to obtain a proximity factor from stored data, such as from the pixel grouping look-up table 118. In certain embodiments, the proximity factor is indicative of the relative location(s) of the pixel(s) within the particular pixel combination. For example, in certain embodiments having a byte-sized pixel location set, the look-up table 118 includes a proximity factor for each of the 256 unique pixel combinations. In such embodiments, the proximity factor may range from zero to four and may indicate the number of distinct pixel groups with the particular pixel location set.

Figure 4:
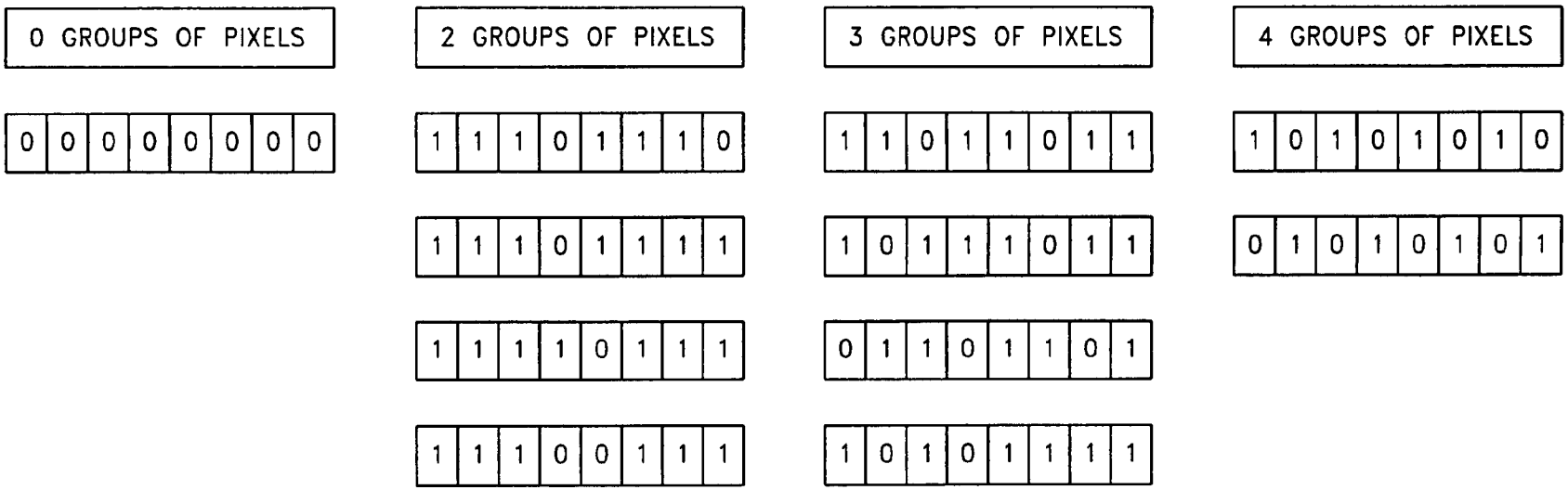
FIG. 4 illustrates exemplary pixel grouping combinations for a set of eight adjacent pixel locations.

FIG. 4 illustrates various exemplary pixel combinations for a set of eight adjacent pixel locations. As illustrated, a pixel location set having no pixels (i.e., 00000000) may be associated with a proximity factor of zero in the pixel grouping look-up table 118. A pixel location set having a pixel combination of 10101010 or 01010101 may be associated with a proximity factor of four, indicative of the four distinct pixel groupings within the set, which is the maximum number of pixel groupings possible in a set of eight adjacent pixel locations. FIG. 4 further illustrates examples of other pixel combinations having two or three distinct pixel groupings. As can be appreciated, other pixel combinations are also possible other than those illustrated in FIG. 4.

With reference to FIG. 3, the proximity factor for the particular pixel location set may be stored in a memory. In other embodiments, a record of the number of each pixel combination identified by the calculation process 300 is kept as an entry in the look-up table 118. For instance, if a pixel combination of 11101111 is identified from a particular location set, the module 108 may increment a value in the look-up table 118 that corresponds to the number of times the pixel combination 11101111 has been identified for a particular image or page.

After obtaining the proximity factor for the particular pixel location set, the module 108 determines if there are additional pixel location sets on the page (or in the image) that have not yet been evaluated, which is represented by block 308. If there are additional location sets within the page/image, the calculation process 300 returns to block 304 to determine the pixel combination for the next pixel location set.

If there are no additional pixel location sets, the calculation process 300 proceeds with block 310. At block 310, the module 108 sums the plurality of proximity factors to generate a proximity value for the page/image, which proximity value is used to estimate the effect of diffusion on toner usage. For example, in certain embodiments, the module 108 may access a memory that has stored each proximity factor for each location set in the page/image or a memory that has maintained a running total (e.g., a sum) of the proximity factors for the page/image.

In yet other embodiments, the module 108 may access a record, such as in the look-up table 118, of how many times each pixel combination occurs with the page/image, and derives from this data the proximity value for the page/image. For a simplified example, if an image results in the pixel combination 11101111 occurring five times and a pixel combination 11011011 occurring six times, the module 108 may calculate a proximity value of 28. That is, the pixel combination 11101111 would be associated with five entries of a "two" value (i.e., two distinct pixel groupings within the pixel combination), and the pixel combination 11011011 would be associated with six entries of a "three" value (i.e., three distinct pixel groupings within the pixel combination).

In other embodiments of the invention, other methods or processes may be performed for generating the proximity value for a particular page/image. For example, the proximity value may be derived from at least one of the proximity factors in a method or algorithm other than summing the individual proximity factors.

In yet other embodiments, the proximity value calculation process 300 advantageously examines two-dimensional pixel location sets instead of, or in combination with, pixel location sets within a single scan line. For example, at block 302, the size of the pixel location set may be established as including a plurality of scan lines or portions of scan lines. At least one proximity factor may be then be assigned to the pixel group combination(s) within each pixel location set in the image and/or page. For instance, the pixel group combinations may comprises one-dimensional and/or two dimensional pixel groupings. The plurality of pixel factors, which are based on the two-dimensional pixel location sets, may then be used by the calculation process 300 at block 310 to generate a proximity value for the image and/or page.

The blocks described with respect to the calculation process 300 illustrated in FIG. 3 are not limited to any particular sequence, and the blocks relating thereto can be performed in other sequences that are appropriate. For example, described blocks may be performed in an order other than that specifically disclosed or may be executed in parallel, or multiple blocks may be combined in a single block. Furthermore, not all blocks of the calculation process 300 need to be executed or additional blocks may be included without departing from the scope of the disclosure.

To estimate how much toner is consumed based on a given pixel count and proximity value for a particular page/image, the module 108 may execute an algorithm based on empirically derived data generated by several test runs for a given printing device. In one embodiment, in order to determine values for such an algorithm, the following procedure is used.

First, several test pages are generated having the same pixel count but each having images being formed mostly of a different pixel combination. For example, a plurality of test pages may be generated, each having 250,000 pixels. A first set of test pages may be mostly made up of pixel location sets each having a pixel combination with two distinct pixel groupings (e.g., pixel combinations with a proximity factor of two). A second set of test pages may be mostly made up of pixel location sets each having a pixel combination with three distinct pixel groupings (e.g., pixel combinations with a proximity factor of three). Other sets of images having other pixel combinations and/or pixel counts may also be used.

For each test page, the user weighs the amount of toner in a printing cartridge of a printing device, runs a large number of copies/prints of the test page (e.g., 1000 copies/prints) and then weighs the amount of toner remaining in the printing cartridge. This copying/printing and weighing procedure is then repeated for each test page. The user is then able to determine the relative amount of toner used for each test page having the same total pixel count but having images being mostly formed of different pixel combinations. From these amounts, the user is able to develop a mapping algorithm that factors a pixel count and a proximity value in estimating the amount of toner used for printing a particular page/image.

In certain embodiments, the mapping algorithm may also take into account the size of the pixel for a particular printing device, the type of printing substrate (e.g., paper) being used, the type of image (e.g., text, half tone, solid area image) being printed, combinations of the same and the like. For example, certain types of paper may have different toner absorption properties, and the toner usage estimation may have to be modified to account for such properties. Furthermore, different amounts of toner may be used with different types of copy sheets (e.g., transparencies versus paper). In yet other embodiments, the type of toner or the type of printing machine is taken into account in estimating toner usage.

Once the mapping algorithm is developed, the printing device having an embodiment of the toner usage monitoring module described herein is capable of estimating the amount of toner used in printing an image/page with a given pixel count and/or proximity value. Because the amount of toner in a full cartridge is generally known, successively subtracting the estimated amount of toner used as pages are printed determines the amount of toner remaining in the cartridge.

As will be understood from the disclosure herein, the foregoing methods and systems may be applied to printing devices that print in black and white, in grayscale and/or in color. For example, with respect to a color printing device, the amount of toner used for each color may be tracked individually. Thus, in determining the amount of toner used in printing a particular page/image, a pixel count and/or proximity value may be calculated for each color.

In addition, the "diffusion effect" may vary with different printers due to differences in the photoreceptor, its charge/discharge levels, the development and developer bias level system, the toner, combinations of the same and the like. Also, the pixel count and proximity value for any given image may vary between printers due to differences in the imager spot size and spacing or resolution (pixels per inch) and the scanning rate (the sweep rate of the laser beam or on/off rate and LED spacing of the LED image bar).

While certain embodiments of the inventions have been described, these embodiments have been presented by way of example only, and are not intended to limit the scope of the disclosure. Indeed, the novel methods and systems described herein may be embodied in a variety of other forms; furthermore, various omissions, substitutions and changes in the form of the methods and systems described herein may be made without departing from the spirit of the disclosure. The accompanying claims and their equivalents are intended to cover such forms or modifications as would fall within the scope and spirit of the disclosure.

What is claimed is:

1. A method for monitoring toner usage in an electronic printing device, the method comprising:

determining a pixel count for a page;

calculating a plurality of proximity factors, each of the plurality of proximity factors equal to a number of independent pixel groups within each of a plurality of sets of pixel locations within the page, wherein a pixel group comprises one or more adjacent pixels and wherein each set of pixel locations is eight adjacent pixel locations;

calculating a proximity value equal to a sum of the plurality of proximity factors; and providing an estimate of toner usage for the page based at least on the pixel count and the proximity value.

2. The method of claim 1, wherein said determining the pixel count is performed by a field programmable gate array (FPGA).

3. The method of claim 1, wherein said calculating the plurality of proximity factors further comprises accessing a look-up table storing the plurality of proximity factors.

4. The method of claim 3, wherein the look-up table associates each possible pixel combination for the set of pixel locations with one of the plurality of proximity factors.

5. The method of claim 1, additionally comprising calculating a toner remaining amount by subtracting the estimated toner usage from a previous toner remaining amount.

6. The method of claim 5, additionally comprising providing a warning signal when the toner remaining amount reaches a predetermined level.

7. The method of claim 1, wherein each set of pixel locations is a two-dimensional array of adjacent pixel locations.

8. A system for estimating the usage of imaging material based on image data, the system comprising:

a controller configured to output image data indicative of an image to be printed on a page;

a cartridge comprising an imaging material, the cartridge configured to selectively transfer the imaging material to print the image on the page based on the image data; and an electronic module in communication with the controller to receive the image data, the electronic module configured to calculate an estimated imaging material usage amount for the page based on a pixel count and a proximity value equal to the sum of a number of independent pixel groups within each of a plurality of sets of pixel locations on the page, wherein the pixel groups comprise one or more adjacent pixels within an image and wherein a pixel location set comprises eight adjacent pixel locations.

9. The system of claim 8, wherein the imaging material comprises toner.

10. The system of claim 8, wherein the electronic module includes a field programmable gate array (FPGA).

11. The system of claim 8, further comprising an imager in communication with the controller and the cartridge, the imager configured to receive the image data and to induce a latent image representing the printed image on an imaging member of the cartridge.

12. The system of claim 10, wherein the FPGA is further configured to count the number of pixels on the page.

13. The system of claim 8, wherein the electronic module comprises a processor configured to execute machine-loadable code for calculating the estimated toner usage.

14. The system of claim 8, wherein the electronic module further comprises a look-up table associating each of a plurality of possible pixel combinations for a pixel location set with one of the number of independent pixel groups.

15. A method for estimating toner usage of a printing device, the method comprising:

providing to a processor first computer instructions for determining a pixel count for a page;

providing to a processor second computer instructions for determining a proximity factor for each of a plurality of sets of pixel locations on the page, each proximity factor equal to a number of independent pixel groups within a respective pixel location set, wherein a pixel group comprises one or more adjacent pixels and wherein each pixel location set is eight adjacent pixel locations;

providing to a processor third computer instructions for calculating a proximity value based on the plurality of proximity factors; and providing to a processor fourth computer instructions for providing an estimate of toner usage for the page based at least on the pixel count and the proximity value;

wherein the method provides an estimate of toner usage for the page based at least on the pixel count.

16. The method of claim 15, wherein each pixel location set is a two-dimensional array of adjacent pixel locations.

17. A printing system for estimating toner usage, the printing system comprising:

means for determining a pixel count for a page;

means for determining a proximity factor for each of a plurality of sets of pixel locations within the page, each proximity factor being equal to a number of independent pixel groups within a respective pixel location set, wherein a pixel group comprises one or more adjacent pixels and wherein a pixel location set comprises eight adjacent pixel locations;

means for calculating a proximity value for the page based on the plurality of proximity factors; and means for providing an estimate of toner usage for the page based at least on the pixel count and the proximity value.

18. The printing system of claim 17, further comprising means for storing data indicative of an amount of toner remaining in the printing system.

19. The printing system of claim 17, further comprising means for associating each possible pixel combination for the pixel location set with one of the plurality of proximity factors.

20. A method for monitoring toner usage in an electronic printing device, the method comprising providing an estimate of toner usage for a page based at least on a pixel count of at least one image on the page and a proximity factor for each of a plurality of sets of pixel locations within the at least one image, each proximity factor equal to a number of independent pixel groups within a respective pixel location set, wherein a pixel group comprises one or more adjacent pixels and wherein a pixel location set comprises eight adjacent pixel locations.

* * * * *

UNITED STATES PATENT AND TRADEMARK OFFICE

CERTIFICATE OF CORRECTION

PATENT NO. : 7,720,397 B2
APPLICATION NO. : 11/242503
DATED : May 18, 2010
INVENTOR(S) : Filbrich et al.

It is certified that error appears in the above-identified patent and that said Letters Patent is hereby corrected as shown below:

At Column 3, Line 61, After "a sheet of paper," please insert the new paragraph -- In certain embodiments, the imager 104 comprises a raster optical scanner (ROS), such as an on/off scanning laser. In other embodiments, the imager 104 comprises any image generator capable of imaging digital input signals to form latent images on an imaging member, such as, for example, a photoconductor drum or belt. For instance, the imager 104 may comprise an LED array or bar, biased electrodes, ion emitters, printing heads, combinations of the same or the like. --

Signed and Sealed this
Fifth Day of April, 2011

David J. Kappos

David J. Kappos
*Director of the United States Patent and Trademark Office*